US012460648B2

(12) United States Patent
Fuglesang et al.

(10) Patent No.: US 12,460,648 B2
(45) Date of Patent: Nov. 4, 2025

(54) PRESSURE BOOSTER WITH INTEGRATED SPEED DRIVE

(71) Applicant: FSubsea AS, Oslo (NO)

(72) Inventors: Alexander Fuglesang, Oslo (NO); Tommy Westberg, Torsby (SE)

(73) Assignee: FSUBSEA AS, Oslo (NO)

( * ) Notice: Subject to any disclaimer, the term of this patent is extended or adjusted under 35 U.S.C. 154(b) by 0 days.

(21) Appl. No.: 17/045,634

(22) PCT Filed: Apr. 26, 2019

(86) PCT No.: PCT/NO2019/050094
§ 371 (c)(1),
(2) Date: Oct. 6, 2020

(87) PCT Pub. No.: WO2019/209120
PCT Pub. Date: Oct. 31, 2019

(65) Prior Publication Data

US 2021/0156384 A1 May 27, 2021

(30) Foreign Application Priority Data

Apr. 26, 2018 (NO) ..... 20180599

(51) Int. Cl.
*F04D 13/02* (2006.01)
*E21B 43/12* (2006.01)
(Continued)

(52) U.S. Cl.
CPC ..... *F04D 13/022* (2013.01); *E21B 43/128* (2013.01); *F04D 13/06* (2013.01);
(Continued)

(58) Field of Classification Search
CPC ..... F04D 13/00; F04D 13/022; F04D 13/06; F04D 13/08; F04D 15/0066;
(Continued)

(56) References Cited

U.S. PATENT DOCUMENTS

2009/0054191 A1 2/2009 Holt et al.
2009/0260367 A1 10/2009 Martin et al.
(Continued)

FOREIGN PATENT DOCUMENTS

EP 2530326 A2 12/2012
GB 604292 A 7/1948
(Continued)

OTHER PUBLICATIONS

BrÅten, Knut; International Search Report; PCT/NO2019/050094; Jun. 28, 2019; 3 pages.

*Primary Examiner* — Philip E Stimpert
(74) *Attorney, Agent, or Firm* — Bradley Arant Boult Cummings LLP

(57) ABSTRACT

Pressure booster (1) for boosting the pressure of petroleum fluids, produced water or seawater, comprising a pressure booster (2) with a motor (3), a rotatable motor shaft (4) and a rotatable pump or compressor shaft (5) where the pressure booster in the form of a centrifugal pump (2) or compressor is arranged. The pressure booster further comprises: a hydraulic variable speed drive (6) arranged between the motor and the pressure booster, the hydraulic variable speed drive comprising an impeller (7) and a turbine (8), wherein the impeller of the hydraulic variable speed drive is arranged on the motor shaft and the turbine of the hydraulic variable speed drive is arranged on the pump or compressor shaft, a common driver side fluid (10) for cooling, lubricating, flushing and powering of the hydraulic variable speed drive, and cooling, lubricating and flushing of the motor and bearings, circulated by one of an impeller (9) on the motor shaft, a pump and a hydraulic power unit, a control system (11) for controlling the coupling of the motor shaft to the pump or compressor shaft by the hydraulic variable speed
(Continued)

drive, wherein the motor shaft drives the pump or compressor shaft via the hydraulic variable speed drive.

29 Claims, 1 Drawing Sheet

(51) Int. Cl.
*F04D 13/06* (2006.01)
*F04D 15/00* (2006.01)
*F04D 25/02* (2006.01)
*F04D 25/06* (2006.01)

(52) U.S. Cl.
CPC ..... *F04D 15/0066* (2013.01); *F04D 25/022* (2013.01); *F04D 25/068* (2013.01)

(58) Field of Classification Search
CPC .... F04D 25/068; F04D 13/0653; F04D 29/58; F04D 29/5806; F04D 29/588; F04B 47/06
See application file for complete search history.

(56) References Cited

U.S. PATENT DOCUMENTS

2013/0101388 A1* 4/2013 Scherrle ..... F04D 25/022 415/1
2015/0104328 A1* 4/2015 Babbitt ..... F04D 25/0686 417/2
2015/0184498 A1* 7/2015 Twidale ..... E21B 43/128 166/66.4
2015/0270768 A1* 9/2015 Sinnerud ..... F03B 11/006 310/104
2016/0025106 A1* 1/2016 Gilarranz ..... F04D 29/584 417/423.8
2016/0043679 A1* 2/2016 Shahi ..... F04D 27/004 417/42
2016/0333677 A1* 11/2016 Westberg ..... F04D 13/025
2016/0348687 A1* 12/2016 Gassmann ..... F04D 29/128

FOREIGN PATENT DOCUMENTS

GB 760568 A 10/1956
JP S57-129931 A 8/1982
NO 333684 B1 * 8/2013 ..... F04B 17/03
WO WO-2006073395 A1 7/2006
WO WO-2010091036 A1 8/2010
WO WO-2012125041 A1 9/2012
WO WO-2013039404 A1 3/2013
WO WO-2014109648 A1 7/2014
WO WO-2016189397 A1 12/2016
WO WO-2017013519 A1 1/2017
WO WO-2018077527 A1 5/2018

* cited by examiner

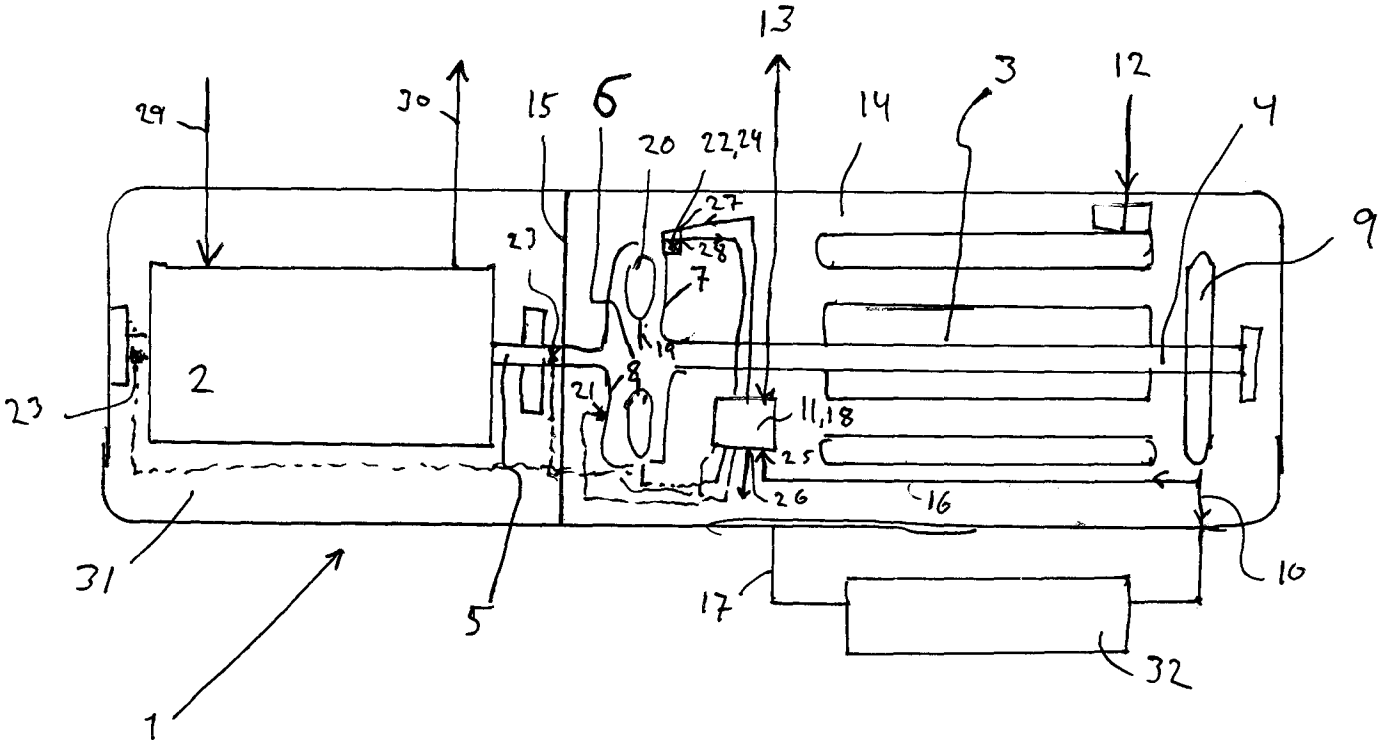
9
4
12
3
14
13
20
22,24
27
28
7
6
15
30
29
2
23
31
1
5
21
11,18
25
26
16
10
32
17

PRESSURE BOOSTER WITH INTEGRATED SPEED DRIVE

TECHNICAL FIELD

The present invention relates to pressure boosters. More particularly, the invention relates to medium and high power and medium and high-speed pressure boosters that can be arranged for operation subsea or in other normally unmanned locations, such as unmanned platforms.

BACKGROUND ART

Pressure booster systems typically require a variable speed drive, for pump or compressor speed and power control, and a barrier fluid supply, for reliable operation.

The term pressure booster means a pump, a multiphase pump or a compressor. The term medium and high power means power from 400 kW to above 1 MW. The term medium and high-speed means speed from 1500 rpm, rotations per minute, to above 3000 rpm.

The variable speed drive-VSD, also termed variable frequency drive-VFD, is not integrated in the pressure booster and is located externally, topsides or subsea. For high power pressure boosters feasible for pressure boosting hydrocarbons, a VFD is a large, heavy, complex and expensive unit. A roto converter, as described in publication WO 2013/039404 A1, can be included in a pressure booster system. However, a roto converter is a passive electric frequency step up device, to be coupled between a subsea step out cable and a subsea pressure booster, to allow longer subsea step out.

The typical barrier fluid supply includes a topside hydraulic power unit-HPU, supply lines and a sophisticated control system for ensuring a controlled supply of barrier fluid at controlled overpressure to a motor compartment. Controlled leakage of barrier fluid out from the motor compartment into the process compartment containing the pump or compressor, by strictly controlling the overpressure, ensures that contaminating process fluid is kept out from the motor compartment.

Recent developments allow eliminating the barrier fluid supply by isolating the motor compartment hermetically from the process compartment, by arranging a fluid proof magnetic coupling between said compartments. By sophisticated fluid and pressure control, the motor compartment fluid can be operated for up to the full life time of a subsea pump. This requires at least a magnetic coupling with a separation wall between the magnetic coupling parts. For further information, reference is made to patent publications WO 2012/125041 A1 and WO 2014/109648 A1.

For pumping at a combination of large flow rate and large pressure head, centrifugal pumps are preferred. The Bornemann twin-screw pump has lower differential pressure capability or pressure head than required.

Only one pump exists capable of delivering sufficient power and speed while both of an external barrier fluid supply and a variable speed drive can be eliminated. For further information, reference is made to patent publications WO 2016/189397 A1 and WO 2017/013519 A1.

The objective of the present invention is to provide a pressure booster that is less expensive and due to simpler design with fewer components that can fail, also more reliable, while still eliminating a variable frequency drive and preferably also the requirement of a continuous supply of barrier fluid at controlled overpressure from a topsides, subsea or onshore location.

SUMMARY OF INVENTION

The invention meets the objective by providing a medium and high power and medium and high-speed pressure booster.

More specifically, the invention provides a pressure booster for boosting the pressure of petroleum fluids, produced water or seawater, comprising a pressure booster with a motor, a rotatable motor shaft and a rotatable pump or compressor shaft where the pressure booster in the form of a centrifugal pump or compressor is arranged. The pressure booster is distinguished in that it further comprises, consists essentially of or consists of:

- a hydraulic variable speed drive arranged between the motor and the pressure booster, the hydraulic variable speed drive comprising an impeller and a turbine, wherein the impeller of the hydraulic variable speed drive is arranged on the motor shaft and the turbine of the hydraulic variable speed drive is arranged on the pump or compressor shaft,
- a common driver side fluid for cooling, lubricating, flushing and powering of the hydraulic variable speed drive; and cooling, lubricating and flushing of the motor and bearings, circulated by at least one of an impeller on the motor shaft, a pump and a hydraulic power unit,
- a control system for controlling the coupling of the motor shaft to the pump or compressor shaft by the hydraulic variable speed drive, wherein the motor shaft drives the pump or compressor shaft via the hydraulic variable speed drive.

The pressure booster preferably comprises a driver side impeller on the rotatable motor shaft, pumping and thereby circulating the common driver side fluid.

In addition to a process fluid inlet and a process fluid outlet, the pressure booster external connections preferably consist essentially of or consist of an electric power supply line and a control link. Thereby a variable frequency drive/speed drive is eliminated, and preferably also a continuous supply of barrier fluid at controlled overpressure from a topsides or onshore location.

The term a control link means a control cable, a control fiber or a wireless communication for control.

The common driver side fluid is a single fluid or fluid mixture, preferably a liquid or liquid mixture, such as oil or a mixture of glycol and water.

The structure coupling the motor shaft to the pump or compressor shaft, comprises, consists essentially of or consists of the hydraulic variable speed drive, powered by the common driver side fluid.

The term consisting/consists essentially of means that the specified system merely includes the specified structural features to be present to be functional, but more structural features can be included but are not essential for the function.

The term consisting/consists of means that the specified system merely contains the specified structural features to be functional, in principle no further structural feature is included.

The term comprises means that the specified system includes the specified structural features as a minimum to be functional, but further structural features can be included, such as for improved functionality.

The hydraulic variable speed drive operatively coupling the motor shaft to the pump or compressor shaft, is arranged in a separate housing, or in a housing common for the motor and the hydraulic variable speed drive or in a housing common for the pump or compressor and the motor and the hydraulic variable speed drive.

Preferably, the pressure booster comprises a common housing.

In another preferable embodiment, the motor and the hydraulic variable speed drive is arranged in a common driver side compartment, as a driver side housing, separated by a gap from a pressure booster housing in the form of a pump housing or a compressor housing. The gap, along the pump or compressor shaft between the pump or compressor and the driver side housing, eliminates any ingress of process fluid into the driver side housing. Optionally, the driver side housing can be separated into a motor housing and a hydraulic variable speed drive housing, with the common driver side fluid circulating through both housings, through piping arranged between said housings.

Preferably, the motor and the hydraulic variable speed drive is arranged in a common driver side compartment isolated from a process fluid to be pressure boosted by the pump or compressor, in a common pressure booster housing, wherein the hydraulic variable speed drive comprises a separation wall on a side of the hydraulic variable speed drive facing the motor or compressor, the separation wall isolates the common driver side compartment from the process fluid. Preferably, the separation wall is dimensioned to isolate the driver side compartment from process fluid over the full pressure range of the process fluid, while the further walls of the driver side compartment can be dimensioned for other pressure. The separation wall preferably is dimensioned to withstand pressures up to static open well pressure. A dynamic/static seal around the motor/compressor shaft, is arranged between said shaft and wall, preferably withstanding said high static open well pressure without leakage and preferably withstanding 50, 80, 15, 200 bar, 300 bar or 350 bar or higher dynamic or static pressure. If allowable, said further walls are preferably dimensioned for low pressure LP or medium pressure MP, allowing use of LP or MP penetrators and feedthroughs, all of which reduce cost.

The pressure booster preferably comprises internal lines, gaps, channels or external pipe sections for circulating the common driver side fluid internally in a motor housing and a hydraulic variable speed drive housing and between said housings, or internally in a common driver side compartment wherein the motor and the hydraulic variable speed drive is arranged, and externally through a cooler.

The pressure booster of the invention preferably comprises a closed loop control system. The advantage is quick response for protecting the pressure booster, whilst control of the production can be from a topsides location, via a control link.

Preferably, a driver side impeller on the rotatable motor shaft, alternatively a separate pump or HPU, pressurizes the common driver side fluid to at least 5 bar absolute pressure, more preferably at least 10 or 15 bar absolute pressure at normal operation, to power an actuator system of the control system and power the hydraulic variable speed drive while eliminating any risk of cavitation, in one of a separate motor housing and a common driver side compartment containing the motor and the hydraulic variable speed drive. Preferably, the common driver side fluid is pressurized to at least 15 bar, more preferably 25, 30 or 50 bar absolute pressure depending on ambient pressure, to eliminate any risk of cavitation. Control response can also be improved at such higher pressure.

Preferably, the hydraulic variable speed drive comprises a non-rotating guide wheel with guide vanes static and/or adjustable arranged between the impeller and turbine, and an actuator system, coupled to the guide vanes, wherein the actuator system controls vane angle of the guide wheel, thereby controlling the rotational coupling from motor shaft to pump or compressor shaft. Preferably, the control system controls the torque of the pump or compressor shaft to be within a maximum torque. For example, torque values may go up to a value corresponding to 6 MW power at relevant speeds, meaning that at power 6 MW at 4000 rpm maximum torque can be up to 14323 Nm at least. The minimum torque is 0 for all pumps, single phase pumps and multiphase pumps, and compressors with the requirement of closed guide vanes. Else, a minimum allowable torque may exist, to eliminate surge/idle problems when gas or multiphase fluid is pressure boosted.

Alternatively, the vanes are arranged in the common driver side fluid flow path coupling the turbine to the impeller, wherein vane angles are controllable by an electric actuator, a rotating vane actuator or another actuator. The most preferable embodiments comprises one or more of the following alternatives, in any combination; adjustable vane angle, controlled by a rotatable vane actuator; vane angle position, controllable via a linear actuator; a liquid filling level of the hydraulic variable speed coupling, as controllable by a scoop pipe and/or a bypass/fill line; a static vane angle and static vane position, with a bypass flow control valve or similar controlling a ratio of flow rate coupling the impeller to the turbine and a flow rate bypassing the coupling; control of axial impeller-turbine distance in the fluid flow path coupling impeller and turbine, controllable by an axial actuator; and a static, non-adjustable vane or fluid flow path structure, controllable by an external VFD/VSD.

The hydraulic variable speed drive preferably also is a speed gear/step up device, allowing the pump/compressor to rotate faster than the motor, thereby reducing losses due to friction in the motor and losses in the electric power supply.

A preferable embodiment of the pressure booster comprises static, fixed vanes or other static structure between impeller and turbine, and a bypass control valve controlling fluid flow in a fluid path coupling the turbine to the impeller and fluid flow in a fluid path bypassing the coupling. At no bypass, the coupling is at maximum, rotating the pump/compressor for example 2 times faster than the motor, or faster. At full bypass, the coupling is disconnected, whereby the motor rotates but not the pump/compressor.

In a further embodiment the pressure booster of the invention comprises static, fixed vanes or structure in the fluid flow path coupling turbine and impeller, coupling the turbine to the impeller at fixed ratio. This embodiment is preferable and sufficient if the power supply comprises a VFD/VSD that can be used to adjust speed. Pressure boosters with permanent magnet motor must comprise a VFD/VFD for starting the motor, which VFD/VSD can be used for general speed control whilst the hydraulic variable speed drive itself is static but preferably is a step up gear, speeding up the speed of the pump/compressor compared to the motor speed (rpm). The benefit is reduced frictional loss in the motor, due to reduced motor rpm for a given pump/compressor rpm, as well as reduced losses in the power supply due to reduced AC frequency.

All of the methods and devices described above for controlling the coupling of the motor shaft to the pump or compressor shaft by the hydraulic variable speed drive are embodiments or parts of the control system (11) for controlling the coupling of the motor shaft to the pump or compressor shaft, wherein the motor shaft drives the pump or compressor shaft via the hydraulic variable speed drive.

Preferably, the control system uses signals from transmitters from the group comprising, consisting essentially of or consisting of: rotational speed of the pump or compressor shaft and rotational speed of the motor shaft, and vane angle of a non-rotating guide wheel with vanes of the hydraulic variable speed drive; and torque on the pump or compressor shaft, alternatively process fluid density or composition, if the process fluid to be pressure boosted is a multiphase fluid. Torque is not a required parameter for single phase pressure boosting, since rotational speed follows pressure head proportionally for a liquid and according to an algorithm or a look up table for gas. However, for multiphase process fluid, torque or a composition or density parameter of the process fluid is a required input parameter for control. Differential pressure measurements can be used for indirectly measuring rotational speed of rotating components and coupling between such components, such as the coupling between turbine and impeller of the hydraulic variable speed drive. To measure rotational speed means in this context to measure rotational speed directly or indirectly via other parameters, such as differential pressure.

The control system operates according to algorithms, look-up tables or combinations thereof. Parameters measured over time may include, in addition to speed, vane angle; and torque or fluid density or composition if multiphase fluid is pressure boosted: displacement, distance, pressure, differential pressure, temperature, vibrations/accelerations, flow rate, permittivity and others. Any of the parameters can be measured singularly or as differentials, such as in a bridge arrangement. The actuator system preferably controls vane angle of the guide wheel, thereby controlling the rotational coupling from motor shaft to pump or compressor shaft. In a preferable embodiment, position or displacement transmitters or sensors are arranged for measuring rotational speed, vane angle and torque. Preferably, inductance-based sensors or transmitters are arranged, measuring at fixed positions or references over time, at sufficient resolution according to common general knowledge. For example, at least two, preferably at least four or ten measurements are made over the period of a discrete or periodic variation.

Preferably, the actuator system comprises a valve and a vane actuator, wherein the common driver side fluid is supplied from the valve to and from the vane actuator, wherein a valve differential pressure is at least 5 or 10 bar between a valve inlet and a valve outlet and a vane actuator differential pressure is at least 3 or 5 bar between a vane actuator inlet and a vane actuator outlet, and the absolute inlet pressure to the vane is 5, 10, 15 bar or 20 bar minimum. The valve can preferably be a servo, a servo proportional or proportional valve. The vane actuator preferably is a rotary vane actuator-RVA, alternatively a linear actuator or a rotary-linear actuator.

In a preferable embodiment, the pressure booster according to the invention comprises an electric actuator. This can reduce energy losses in the hydraulic variable speed drive, since actuation can be powered by electricity. Electrical actuators can be rotary, linear or rotary-linear actuators.

Instead of a non-rotating guide wheel with variable angle vanes for control of coupling between impeller and turbine of the hydraulic variable speed drive, variable impeller-turbine distance and/or variable volume liquid filing and/or fluid bypass control can be used as control mechanisms of the hydraulic variable speed drive. This is particularly preferable for topsides pressure boosters on unmanned locations, and/or low to medium power pressure boosters.

The motor preferably is an asynchronous induction motor. Also, other motors can be possible to use, such as motors with permanent magnets in the rotor, but other motors may require a different and more complex control system and a variable frequency drive and may not allow soft start, soft stop and maximum torque protection without comprehensive control devices and design changes.

Preferably, the hydraulic variable speed drive controls the speed of the pump, multi-phase pump or compressor to be in a range from 0 to at least 2 times the rotational speed of the motor. For a 3000 rpm or 3600 rpm motor in a pump, the speed range then is: 0 rpm to at least 6000 rpm or 0 rpm to at least 7200 rpm, respectively.

For subsea pressure boosters, preferably using a glycol and water mixture as the common driver side fluid, a subsea accumulator containing driver side fluid, or a receptacle or port for driver side fluid filling by a remotely operated vehicle ROV, can be arranged. Continuous external supply of common driver side fluid at controlled overpressure, supplied through an umbilical bore from an onshore or topsides location, can thereby be eliminated.

The invention also provides a method for boosting the pressure of petroleum fluids, produced water or seawater, without a topsides or subsea VSD/VFD variable speed drive and preferably without continuous external barrier fluid supply, distinguished in that the method comprises the steps:

- to arrange a pressure booster according to the invention to an inlet for petroleum fluids, produced water or seawater and an outlet for said petroleum fluids, produced water or seawater,
- to connect an electric power supply line,
- to connect a control link, and
- to operate the pressure booster.

The method preferably includes that the pressure booster is controlled via an active closed-circuit control system integrated in the pressure booster, controllable via the control link, or connected via the control link, wherein the control is based on signals from transmitters for at least rotational speed of the pump or compressor shaft and the motor shaft, and vane angle of a non-rotating guide wheel with vanes of the hydraulic variable speed drive or another integrated adjustable vane arrangement or speed/coupling control system, as discussed above, in any combination; and torque on the pump or compressor shaft if the process fluid to be pressure boosted is a multiphase fluid.

Preferably, the pressure booster and the method of the invention comprise coupling to an umbilical flow bore or separate line with supply of fluid for flow assurance, in the form of glycol, glycol and water mixture, or methanol, for use as and supply of common driver side fluid (10). Flow assurance is crucial for reliable production from subsea production systems, whereby hydrate formation is the major risk for production stop, which hydrate formation can be avoided or overcome by injection of glycol, glycol and water mixture, or methanol in the production flow. Supplying and using the fluid for flow assurance as common driver side fluid is apparently novel. Said supply preferably is at controlled overpressure to the common driver side compartment 14 compared to the process compartment 31, provided by pressure measurements in said compartments and controllers/valves in the supply bore/line.

The invention also provides use of the pressure booster according to the invention, for boosting the pressure of petroleum fluids, produced water or seawater. Preferably, the use is at subsea locations or on platforms and locations normally unmanned.

BRIEF DESCRIPTION OF DRAWINGS

FIG. 1 illustrates an embodiment of a pressure booster of the invention.

DETAILED DESCRIPTION OF THE INVENTION

Reference is made to FIG. 1, illustrating a pressure booster 1 of the invention. More specifically, the embodiment is a pressure booster 1 for boosting the pressure of petroleum fluids, produced water or seawater, comprising a pressure booster 2 with a motor 3, a rotatable motor shaft 4 and a rotatable pump or compressor shaft 5 where a centrifugal pump 2 or compressor is arranged. An inlet 29 receives process fluid. Pressure boosted process fluid is delivered through an outlet 30. The pressure booster 2 is a pump if the process fluid is liquid or multiphase fluid, and a compressor if the process fluid is gas. A hydraulic variable speed drive 6 arranged between the motor and the pump or compressor, rotatably couples the motor shaft and the pump or compressor shaft 5. The hydraulic variable speed drive comprises an impeller 7 and a turbine 8, wherein the impeller of the hydraulic variable speed drive is arranged on the motor shaft and the turbine of the hydraulic variable speed drive is arranged on the pump or compressor shaft.

A driver side impeller 9 is arranged on the rotatable motor shaft. The pressure booster contains a common driver side fluid 10 for cooling, lubrication, flushing and powering and control of the hydraulic variable speed drive, and cooling, lubrication and flushing of the motor and bearings, circulated by the driver side impeller 9. A control system 11 controls the coupling of the motor shaft to the pump or compressor shaft by the hydraulic variable speed drive, wherein the motor shaft drives the pump or compressor shaft via the hydraulic variable speed drive. Furthermore, an electric power supply line 12 delivers the required electric power, and a control link 13 allows transmitting control signals to and from the pressure booster.

The illustrated embodiment comprises a common driver side compartment 14 isolated by a separation wall 15 from a process fluid to be pressure boosted by the pump or compressor, in a single pressure booster unit 1. The walls of the process compartment 31 can be dimensioned for higher pressure than the walls of the common driver side compartment, except for the separation wall 15 that is common between the compartments.

The separation wall 15 comprises a seal or packer, between the separation wall and pump or compressor shaft. To eliminate continuous common driver side fluid supply, a common driver side fluid accumulator is preferably arranged for common driver side fluid replacement or supply, if or when required. Alternatively, a port for common driver side fluid supply via an ROV-remotely operated vehicle, is arranged. Alternatively, a flow bore in an umbilical can be used to supply common driver side fluid, for example in the electric power supply line 12. Preferably, the pressure booster of the invention comprises coupling to an umbilical flow bore or separate line with supply of fluid for flow assurance, in the form of glycol, glycol and water mixture, or methanol, for use as and supply of common driver side fluid (10). Alternatively, common driver side fluid leakage and supply can be eliminated by arranging a magnetic coupling with a separation wall between magnetic coupling sides, arranged between the driver side compartment and pump or compressor compartment, in the common pressure booster housing, thereby separating the compartments hermetically and eliminating any leakage and thereby any requirement for supply of common driver side fluid.

The common driver side fluid is circulating internally in the common driver side compartment through internal lines, gaps, channels 16; and externally through external pipe sections 17, through a cooler 32.

The hydraulic variable speed drive comprises a non-rotating guide wheel 19 with vanes 20 arranged between the impeller and turbine, and an actuator system 18, coupled to the guide vanes. The actuator system 18 controls vane angle of the guide wheel, thereby controlling the rotational coupling from motor shaft to pump or compressor shaft. The actuator system 18 is a part of the control system 11. Alternatively, the vanes are arranged in the common driver side fluid flow path coupling the impeller to the turbine, wherein vane angles are controllable by an electric actuator, a rotating vane actuator or another actuator. Controlling the vane angles control how much of the common driver side fluid shall flow through the flow path acting to couple the impeller to the turbine, and how much of the fluid shall bypass the coupling.

Alternatively, only static vanes or static guide structure are used. This is preferable if the pressure booster motor is a permanent magnet motor, which require a topsides or subsea VFD/VSD for start of the motor, which topsides or subsea VFD/VSD can readily be used for speed control, whilst the hydraulic variable speed drive of the pressure booster acts like a step up gear. Frictional losses of the common driver side fluid, or any alternative fluid, follows fluid velocity at an exponent of about 2,7, therefore the benefit of reduced motor rpm is substantial.

The control system comprises transmitters for at least rotational speed 21 of the pump or compressor shaft and the motor shaft, and vane angle 22 of a non-rotating guide wheel with vanes of the hydraulic variable speed drive; and torque 23 on the pump or compressor shaft if the process fluid to be pressure boosted is a multiphase fluid.

The illustrated actuator system 18 comprises a valve 11 and a vane actuator 24, wherein the common driver side fluid is supplied from the valve to and from the vane actuator, wherein a valve differential pressure is at least 5 bar or 10 bar between a valve inlet 25 and a valve outlet 26 and an actuator differential pressure is at least 3 bar or 5 bar between an actuator inlet 27 and an actuator outlet 28, and the absolute inlet pressure to the vane is 5, 10, 15 or 20 bar minimum.

The pressure booster, method and use of the invention enables the following features, advantages or technical effects:

- Soft start and stop of pump ("motor protection"—reduce mechanical wear/tear)
- Variable speed control (with constant speed motor), which is essential in subsea rotating machinery
- Operating pump at higher than motor speed (up to at least 2× motor speed)—less viscous losses than if both pump and motor shaft spins at for example 6000 rpm and more stable system (less vibration)
- Inherent regulating capability—constant power transmitted provided guide vane position is constant—if gas enters pump then torque drops and rpm increases to keep kW (power) constant—and higher speed removes the gas (and vice versa)

Improved rotodynamic stability in general (by having "non-mechanical contact" between motor and pump shafts)

Closed Loop Electric Control system preferably used to regulate Hydraulic variable speed drive HVSD in a subsea or unmanned Rotating Machine; has not been used subsea before.

Using the inherent differential pressure in the common driver side fluid to actuate the actuator.

Using the same fluid in the HVSD as is in the el. motor (no separating seal or wall—this is normally present, not separate volumes or fluids, in principle not separate pressures either)

Actuator (such as RVA) position measurement—differential measurements instead of "single ended"—as the actuator or RVA moves in many directions due to pressures and exact position is needed—unique Overpressure of the common driver side fluid—at least 5 bar absolute pressure as opposed to conventional hydraulic couplings.

Driver side arrangement with orifices and gaps and lines to control the fluid flows and pressure throughout the "Motor-HVSD-Pump" system (stabilize, cool and lubricate)

Allow to eliminate barrier fluid supply from topsides or onshore, at least continuous supply or/and continuous connection.

Eliminate a separate barrier fluid and accordingly any separate barrier fluid supply.

The pressure booster of the invention may include any feature or step here described or illustrated, in any operative combination, wherein each such operative combination is an embodiment of the present invention. The method of the invention may include any feature or step here described or illustrated, in any operative combination, wherein each such operative combination is an embodiment of the present invention.

The invention claimed is:

1. A pressure booster adapted to boost pressure of petroleum fluids, produced water or seawater, with the pressure booster submerged in sea, the pressure booster comprising:

a motor;

a pressure booster in the form of a centrifugal pump or a compressor;

a rotatable motor shaft; and a pressure booster shaft;

a coupling between the rotatable motor shaft and the pressure booster shaft, wherein the coupling consists of:

a hydraulic variable speed drive arranged between the rotatable motor shaft and the pressure booster shaft with an impeller arranged on the rotatable motor shaft and a turbine arranged on the pressure booster shaft;

a common driver side fluid configured for cooling, lubricating, flushing and powering of the hydraulic variable speed drive and cooling, lubricating and flushing of the motor and bearings;

a control system adapted to control a coupling of the rotatable motor shaft to the pressure booster shaft by the hydraulic variable speed drive, wherein the rotatable motor shaft drives the pressure booster shaft via the hydraulic variable speed drive;

a driver side impeller on the rotatable motor shaft that pressurizes the common driver side fluid to at least 5 bar overpressure, wherein the driver side impeller is configured to power an actuator system of the control system and power the hydraulic variable speed drive, further comprising:

a common driver side compartment containing the motor and the hydraulic variable speed drive;

a cooler for cooling the common driver side fluid, wherein the cooler is arranged outside the common driver side compartment; and wherein the cooler and inlet and outlet pipe sections to and from the cooler are the only structure outside the common driver side compartment to which the common driver side fluid is configured to flow, wherein the actuator system comprises a valve and a vane actuator, the common driver side fluid is supplied from the valve to and from the vane actuator, and further wherein the actuator system controls vane angle of a guide wheel.

2. A method for boosting the pressure of petroleum fluids, produced water or seawater, without an electric variable speed drive, the method consisting of:

fluidly connecting the pressure booster according to claim 1 to an inlet for petroleum fluids, produced water or mixtures thereof, or seawater and an outlet for the petroleum fluids, produced water or seawater;

connecting an electric power supply line;

connecting a control link;

operating the pressure booster by starting at no overpressure and then pressurizing the common driver side fluid, by the driver side impeller on the rotatable motor shaft, to power the actuator system of the control system and power the hydraulic variable speed drive in one of the separate motor housing and the common driver side compartment containing the motor and the hydraulic variable speed drive; and wherein the apparatus is controlled via an active closed-circuit control system integrated in the apparatus, controllable via the control link, wherein control is based on signals from transmitters for at least rotational speed of the pump or compressor shaft and the rotatable motor shaft, and vane angle of vanes of the hydraulic variable speed drive, and, if a process fluid to be pressure boosted is a multiphase fluid containing gas, torque on the pump or compressor shaft.

3. An apparatus for boosting pressure a process fluid, the apparatus consisting essentially of:

a motor;

a pressure booster in the form of a centrifugal pump or a compressor;

a rotatable motor shaft; and a pressure booster shaft in the form of a centrifugal pump shaft or compressor shaft;

a coupling between the rotatable motor shaft and the pressure booster shaft, the coupling consisting of:

a hydraulic variable speed drive arranged between the rotatable motor shaft and the pressure booster shaft, the hydraulic variable speed drive comprising an impeller, a turbine, a guide wheel with vanes, and an actuator system comprising a valve and a vane actuator, the common driver side fluid is supplied from the valve to and from the vane actuator, and further wherein the actuator system controls an angle of the vanes, wherein the impeller of the hydraulic variable speed drive is arranged on the rotatable motor shaft and a turbine of the hydraulic variable speed drive is arranged on the centrifugal pump shaft or compressor shaft of the pressure booster;

a common driver side fluid for cooling, lubricating, flushing and powering of the hydraulic variable speed drive and cooling, lubricating and flushing of the motor and bearings;

a control system for controlling a coupling of the rotatable motor shaft to the pump or compressor shaft by the hydraulic variable speed drive, without any electric variable speed drive, wherein the rotatable motor shaft drives the centrifugal pump shaft or compressor shaft via the hydraulic variable speed drive; and a driver side impeller on the rotatable motor shaft that pressurizes the common driver side fluid, wherein the driver side impeller is configured to power an actuator system of the control system and power the hydraulic variable speed drive in one of a separate motor housing and a common driver side compartment containing the motor and the hydraulic variable speed drive, a cooler for cooling the common driver side fluid, arranged outside the motor housing or the common driver side compartment, fluidly coupled to the common driver side fluid; and wherein the cooler and inlet pipe to and outlet pipe from the cooler are the only structure outside the motor housing or the common driver side compartment to which flow of the common driver side fluid is configured to flow, wherein the common driver side fluid circulates in the apparatus only in the motor housing or the common driver side compartment and directly to and from the cooler.

4. The apparatus according to claim 3, wherein the impeller of the hydraulic variable speed drive is arranged directly on the motor shaft and the turbine is arranged directly on the centrifugal pump shaft or compressor shaft.

5. The apparatus according to claim 3, wherein, in addition to a process fluid inlet and a process fluid outlet, external connections consist of an electric power supply line and a control link.

6. The apparatus according to claim 3, wherein the motor and the hydraulic variable speed drive are arranged in the common driver side compartment isolated from the process fluid, wherein the hydraulic variable speed drive comprises a separation wall on a side of the hydraulic variable speed drive facing the motor or compressor, the separation wall isolates the common driver side compartment from the process fluid.

7. The apparatus according to claim 3, comprising internal lines, gaps, channels or external pipe sections for circulating the common driver side fluid internally in the motor housing and a hydraulic variable speed drive housing and between the motor housing and the hydraulic variable speed drive housing, or internally in the common driver side compartment.

8. The apparatus according to claim 3, wherein:

the pressure booster comprises a control system that maintains a set point or state based on internal feedback and without external input; and the control system comprises a closed loop control system.

9. The apparatus according to claim 3, wherein:

the driver side impeller on the rotatable motor shaft pressurizes the common driver side fluid to an overpressure of 5-50 bar at normal operation, to power the actuator system of the control system and power the hydraulic variable speed drive while eliminating any risk of cavitation, in the common driver side compartment containing the motor and the hydraulic variable speed drive; and the common driver side fluid is a common driver side liquid or liquid mixture.

10. The apparatus according to claim 3, wherein the hydraulic variable speed drive comprises vanes arranged in a common driver side fluid flow path coupling the impeller to the turbine, and the actuator system, coupled to the vanes, wherein the actuator system controls vane angle of a guide wheel, thereby controlling a rotational coupling from the rotatable motor shaft to the centrifugal pump shaft or compressor shaft.

11. The apparatus according to claim 3, wherein the control system comprises transmitters for at least rotational speed of the centrifugal pump shaft or compressor shaft and the rotatable motor shaft, and vane angle of a non-rotating guide wheel with vanes of the hydraulic variable speed drive and torque on the centrifugal pump shaft or compressor shaft if a process fluid to be pressure boosted is a multiphase fluid.

12. The apparatus according to claim 10, wherein:

a valve differential pressure is at least 5 bar between a valve inlet and a valve outlet and an actuator differential pressure is at least 3 bar between an actuator inlet and an actuator outlet, and the absolute inlet pressure to the vane is 20 bar minimum.

13. The apparatus according to claim 3, comprising an electric actuator.

14. The apparatus according to claim 3, wherein the motor is an asynchronous induction motor.

15. The apparatus according to claim 3, wherein the hydraulic variable speed drive controls a speed of the pressure booster to be in a range from 0 to at least 2 times a rotational speed of the motor.

16. A method for boosting the pressure of petroleum fluids, produced water or seawater, without an electric variable speed drive, the method consisting essentially the steps of:

fluidly connecting the apparatus according to claim 3 to an inlet for petroleum fluids, produced water or seawater and an outlet for the petroleum fluids, produced water or seawater;

connecting an electric power supply line;

connecting a control link;

operating the pressure booster by pressurizing the common driver side fluid, by the driver side impeller on the rotatable motor shaft, to power the actuator system of the control system and power the hydraulic variable speed drive in one of the separate motor housing and the common driver side compartment containing the motor and the hydraulic variable speed drive; and wherein the apparatus is controlled via an active closed-circuit control system integrated in the apparatus, controllable via the control link, wherein control is based on signals from transmitters for at least rotational speed of the pump or compressor shaft and the rotatable motor shaft, and vane angle of vanes of the hydraulic variable speed drive, and, if a process fluid to be pressure boosted is a multiphase fluid, torque on the pump or compressor shaft.

17. An apparatus for boosting pressure of petroleum fluids, produced water or seawater, the apparatus consisting essentially of:

a motor;

a pressure booster in the form of a centrifugal pump or a compressor;

a rotatable motor shaft; and a pressure booster shaft in the form of a centrifugal pump shaft or compressor shaft;

a coupling between the rotatable motor shaft and the pressure booster shaft, the coupling comprising:

a hydraulic variable speed drive arranged between the rotatable motor shaft and the pressure booster shaft, the hydraulic variable speed drive comprising an impeller, a turbine, a guide wheel with vanes, and an actuator system comprising a valve and a vane actuator, the common driver side fluid is supplied from the valve to and from the vane actuator, and further wherein the actuator system controls an angle of the vanes, wherein the impeller of the hydraulic variable speed drive is arranged on the rotatable motor shaft and a turbine of the hydraulic variable speed drive is arranged on the centrifugal pump shaft or compressor shaft of the pressure booster, wherein the hydraulic variable speed drive is the only coupling rotatably coupling the motor shaft and the pressure booster shaft;

a common driver side fluid for cooling, lubricating, flushing and powering of the hydraulic variable speed drive and cooling, lubricating and flushing of the motor and bearings;

a control system for controlling a coupling of the rotatable motor shaft to the pump or compressor shaft by the hydraulic variable speed drive, wherein the rotatable motor shaft drives the centrifugal pump shaft or compressor shaft via the hydraulic variable speed drive, without control of any electric variable speed drive;

a driver side impeller on the rotatable motor shaft, or a pump or a hydraulic power unit, that pressurizes the common driver side fluid, wherein the driver side impeller, the pump or hydraulic power unit are configured to power an actuator system of the control system and power the hydraulic variable speed drive in one of a separate motor housing and a common driver side compartment containing the motor and the hydraulic variable speed drive;

a cooler for cooling the common driver side fluid, arranged outside the motor housing or the common driver side compartment, fluidly coupled to the common driver side fluid;

wherein the cooler is the only structure outside the motor housing or the common driver side compartment to which flow of the common driver side fluid is configured to flow, wherein the common driver side fluid circulates in the apparatus only in the motor housing or the common driver side compartment and the cooler; and wherein the rotatable coupling between the motor shaft and pump or compressor shaft is by the hydraulic variable speed drive only.

18. The apparatus according to claim 17, wherein, in addition to a process fluid inlet and a process fluid outlet, external connections consist of an electric power supply line and a control link.

19. The apparatus according to claim 17, wherein the motor and the hydraulic variable speed drive are arranged in the common driver side compartment isolated from a process fluid to be pressure boosted by the centrifugal pump or compressor, wherein the hydraulic variable speed drive comprises a separation wall on a side of the hydraulic variable speed drive facing the motor or compressor, the separation wall isolates the common driver side compartment from the process fluid.

20. The apparatus according to claim 17, comprising internal lines, gaps, channels or pipe sections for circulating the common driver side fluid internally in a motor housing and a hydraulic variable speed drive housing and between the motor housing and the hydraulic variable speed drive housing, or internally in the common driver side compartment wherein the motor and the hydraulic variable speed drive are arranged to and from the external cooler.

21. The apparatus according to claim 17, wherein the pressure booster comprises a closed loop control system.

22. The apparatus according to claim 17, wherein:

the driver side impeller on the rotatable motor shaft pressurizes the common driver side fluid to an overpressure of 5-50 bar at normal operation, to power the actuator system of the control system and power the hydraulic variable speed drive while eliminating any risk of cavitation, in one of the separate motor housing and the common driver side compartment containing the motor and the hydraulic variable speed drive; and the common driver side fluid is a common driver side liquid or liquid mixture.

23. The apparatus according to claim 17, wherein the hydraulic variable speed drive comprises vanes arranged in a common driver side fluid flow path coupling the impeller to the turbine, and the actuator system, coupled to the vanes, wherein the actuator system controls vane angle of a guide wheel, thereby controlling a rotational coupling from the rotatable motor shaft to the centrifugal pump shaft or compressor shaft.

24. The apparatus according to claim 17, wherein the control system comprises transmitters for at least rotational speed of the centrifugal pump shaft or compressor shaft and the rotatable motor shaft, and vane angle of a non-rotating guide wheel with vanes of the hydraulic variable speed drive and torque on the centrifugal pump shaft or compressor shaft if a process fluid to be pressure boosted is a multiphase fluid.

25. The apparatus according to claim 23, wherein:

a valve differential pressure is at least 5 bar between a valve inlet and a valve outlet and an actuator differential pressure is at least 3 bar between an actuator inlet and an actuator outlet, and the absolute inlet pressure to the vane is 20 bar minimum.

26. The apparatus according to claim 17, comprising an electric actuator.

27. The apparatus according to claim 17, wherein the motor is an asynchronous induction motor.

28. The apparatus according to claim 17, wherein the hydraulic variable speed drive controls a speed of the pressure booster to be in a range from 0 to at least 2 times a rotational speed of the motor.

29. A method for boosting the pressure of petroleum fluids, produced water or mixtures thereof, or seawater, without an electric variable speed drive, the method consisting essentially of:

fluidly connecting the apparatus according to claim 17 to an inlet for petroleum fluids, produced water or seawater and an outlet for the petroleum fluids, produced water or seawater;

connecting an electric power supply line;

connecting a control link;

operating the pressure booster by pressurizing the common driver side fluid, by the driver side impeller on the rotatable motor shaft, to power the actuator system of the control system and power the hydraulic variable speed drive in one of the separate motor housing and the common driver side compartment containing the motor and the hydraulic variable speed drive; and wherein the apparatus is controlled via an active closed-circuit control system integrated in the apparatus, controllable via the control link, wherein control is based on signals from transmitters for at least rotational speed of the pump or compressor shaft and the rotatable motor shaft, and vane angle of vanes of the hydraulic variable speed drive, and, if a process fluid to be pressure boosted is a multiphase fluid, torque on the pump or compressor shaft.

* * * * *